US009870723B2

(12) United States Patent
Takashima et al.

(10) Patent No.: US 9,870,723 B2
(45) **Date of Patent: *Jan. 16, 2018**

(54) BAND AND METHOD FOR WINDING BAND

(71) Applicant: SATO HOLDINGS KABUSHIKI KAISHA, Tokyo (JP)

(72) Inventors: Tetsuya Takashima, Tokyo (JP); Hiroyuki Konuma, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/820,984

(22) Filed: Aug. 7, 2015

(65) Prior Publication Data

US 2016/0012755 A1 Jan. 14, 2016

Related U.S. Application Data

(63) Continuation of application No. 13/876,923, filed as application No. PCT/JP2011/005867 on Oct. 20, 2011, now Pat. No. 9,147,354.

(30) Foreign Application Priority Data

Oct. 21, 2010 (JP) ..... 2010-236490
Dec. 22, 2010 (JP) ..... 2010-286377

(51) Int. Cl.
*A44C 5/00* (2006.01)
*G09F 3/00* (2006.01)
*G09F 3/10* (2006.01)

(52) U.S. Cl.
CPC ..... *G09F 3/005* (2013.01); *G09F 3/10* (2013.01)

(58) Field of Classification Search
CPC ..... A44C 5/0015; A61B 19/44; B42D 15/00; B42P 2241/22; G09F 3/005
(Continued)

(56) References Cited

U.S. PATENT DOCUMENTS 1,806,142 A * 5/1931 Beck ..... G09F 3/12 40/633
3,808,718 A * 5/1974 Christiansen ..... A45C 13/42 283/80

(Continued)

FOREIGN PATENT DOCUMENTS

AU 2003298632 A1 7/2004
CA 2 516 180 5/2005

(Continued)

OTHER PUBLICATIONS

European Search Report, dated Jul. 29, 2016, issued in corresponding European Patent Application No. EP 16 000 968.4. Total 12 pages.

(Continued)

*Primary Examiner* — Shin Kim
(74) *Attorney, Agent, or Firm* — Ostrolenk Faber LLP

(57) ABSTRACT

A wristband configured adhering rear surface portions of band base material to each other. The present wristband is characterized in that, when winding the wristband on a portion on which the wristband is to be wound. The rear surface of a first winding region (6) having an exposed adhesive layer (3), and the rear surface of a second winding region are adhered to each other such that a first adhesion position guide (18, 19A) and a second adhesion position guide (19) are aligned with each other while a (second adhesion region (23)) of the adhesive layer (3) is left so that the portion can be exposed, whereby the wristband can be formed in a ring shape and wound on the portion on which the wristband is to be wound. The first winding region (6), (Continued)

which has the adhesive layer (3) having the portion so that the portion can be exposed, can be adhered to the front surface of the second winding region (7). A strip of the wristbands separated by base material separation lines and a mount over the adhesive layer with mount separation lines not at the base separation lines, allowing parts of the mount to be removed.

30 Claims, 12 Drawing Sheets

(58) Field of Classification Search
USPC ..... 40/6, 633
See application file for complete search history.

(56) References Cited

U.S. PATENT DOCUMENTS 3,994,085 A * 11/1976 Groselak ..... G09F 3/04 283/106
4,682,431 A * 7/1987 Kowalchuk ..... G09F 3/005 40/633
4,865,352 A * 9/1989 Gollon ..... G09F 3/0288 283/79
4,916,841 A * 4/1990 Dawson ..... G09F 3/10 40/6
5,104,148 A * 4/1992 Neal ..... G09F 3/14 283/81
5,226,994 A * 7/1993 Breen ..... B31B 1/02 156/152
5,279,057 A * 1/1994 Melin ..... G09F 3/00 40/630
5,318,817 A * 6/1994 Ohno ..... B41M 5/41 40/6
5,366,249 A * 11/1994 Diemert ..... G09F 3/0288 283/80
5,560,657 A * 10/1996 Morgan ..... G09F 3/0292 283/80
5,653,472 A 8/1997 Huddleston ..... 283/75
5,799,426 A * 9/1998 Peterson ..... G09F 3/005 24/304
6,349,493 B1 * 2/2002 Newman ..... G09F 3/005 40/633
6,426,139 B1 * 7/2002 Ezra ..... B43K 29/00 428/100
6,641,048 B1 11/2003 Schintz et al. ..... 235/487
6,782,648 B1 * 8/2004 Mosher, Jr. ..... G09F 3/005 156/384
6,857,801 B2 * 2/2005 Van Bever ..... B41J 3/4075 40/316
7,188,764 B2 * 3/2007 Penuela ..... G09F 3/005 235/375
7,320,194 B2 * 1/2008 Ali ..... G09F 3/005 40/633
7,322,613 B2 * 1/2008 Penuela ..... G09F 3/0288 283/105
7,398,999 B2 * 7/2008 Kaufman ..... B42D 15/00 283/101
7,520,079 B2 * 4/2009 Stallings ..... G09F 3/005 40/630
7,752,794 B2 * 7/2010 Kerlin ..... G09F 3/005 40/633
7,866,072 B2 * 1/2011 Diliscia ..... G09F 3/00 40/304
8,117,777 B2 * 2/2012 Chadwick ..... G09F 3/005 40/633
8,167,336 B2 * 5/2012 Minor ..... G09F 3/0288 283/103
8,220,191 B2 * 7/2012 Waltersdorf ..... G07C 9/00007 40/633
8,595,963 B2 * 12/2013 Olivarez ..... G09F 3/0295 40/316
9,147,354 B2 * 9/2015 Takashima ..... G09F 3/005
2004/0113421 A1 * 6/2004 Penuela ..... G09F 3/0288 283/105
2004/0164544 A1 * 8/2004 Thall ..... G09F 3/0288 283/62
2006/0249582 A1 * 11/2006 Golabek, Jr. ..... B01L 3/5453 235/462.01
2007/0028495 A1 * 2/2007 Kotik ..... G06F 19/323 40/633
2007/0120358 A1 * 5/2007 Waggoner ..... G09F 3/005 283/81
2009/0193696 A1 * 8/2009 Golabek, Jr. ..... B01L 3/5453 40/299.01
2010/0011643 A1 * 1/2010 Chadwick ..... G09F 3/005 40/633
2012/0023796 A1 * 2/2012 Waltersdorf ..... A44C 5/0015 40/633
2012/0124877 A1 * 5/2012 Waltersdorf ..... G09F 3/005 40/633
2012/0198738 A1 * 8/2012 Olivarez ..... G09F 3/0295 40/316
2013/0145663 A1 * 6/2013 Greer ..... G09F 3/02 40/633

FOREIGN PATENT DOCUMENTS

| | | |
|---|---|---|
| CA | 2 606 903 | 11/2007 |
| CN | 1729109 | 2/2006 |
| CN | 101193800 | 6/2008 |
| CN | 101499141 | 8/2009 |
| EP | 2 133 276 A1 | 12/2009 |
| JP | 6-73140 | 10/1994 |
| JP | 2003-164499 | 6/2003 |
| JP | 2005-288906 | 10/2005 |
| JP | 2006-039209 | 2/2006 |
| JP | 2006-511378 | 4/2006 |
| JP | 2008-541154 | 11/2008 |
| WO | WO 2004/061749 A2 | 7/2004 |
| WO | WO 2005/081928 A2 | 9/2005 |
| WO | WO 2006/121728 A2 | 11/2006 |
| WO | WO 2008/129903 A1 | 10/2008 |

OTHER PUBLICATIONS

International Search Report and Written Opinion dated Jan. 24, 2012 issued in corresponding International patent application No. PCT/JP2011/005867.
Supplementary Partial European Search Report, dated Jun. 10, 2015, issued in corresponding European Patent Application No. EP 11834053.8. Total 6 pages.

* cited by examiner

Fig. 1A
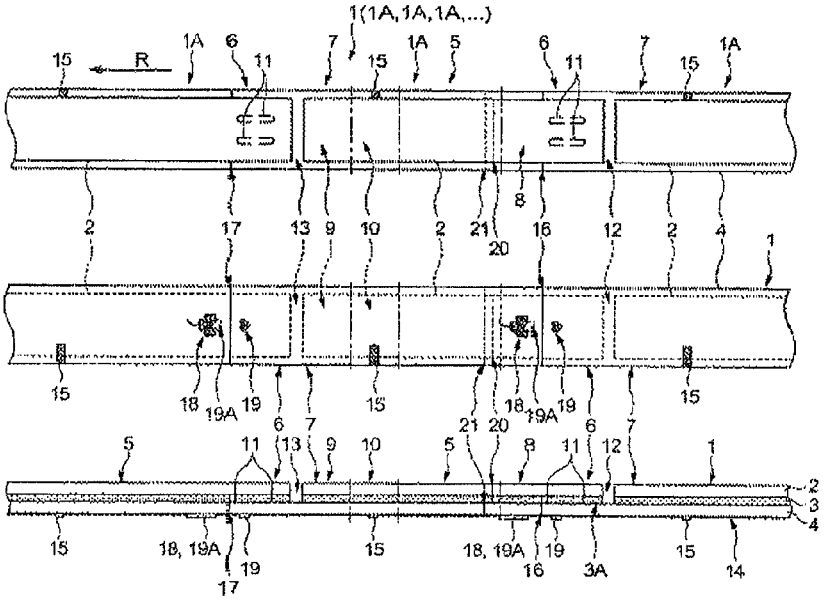
Fig. 1B
Fig. 1C
Fig. 2A
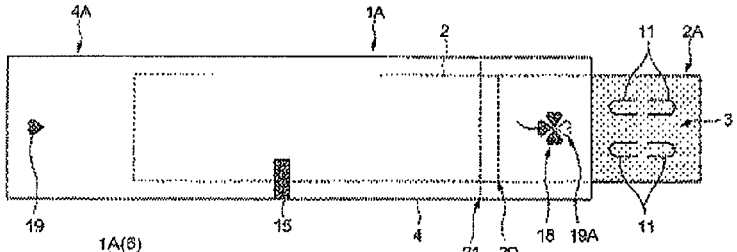
Fig. 2B
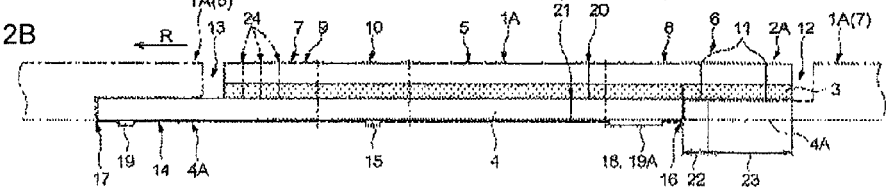

Fig. 5
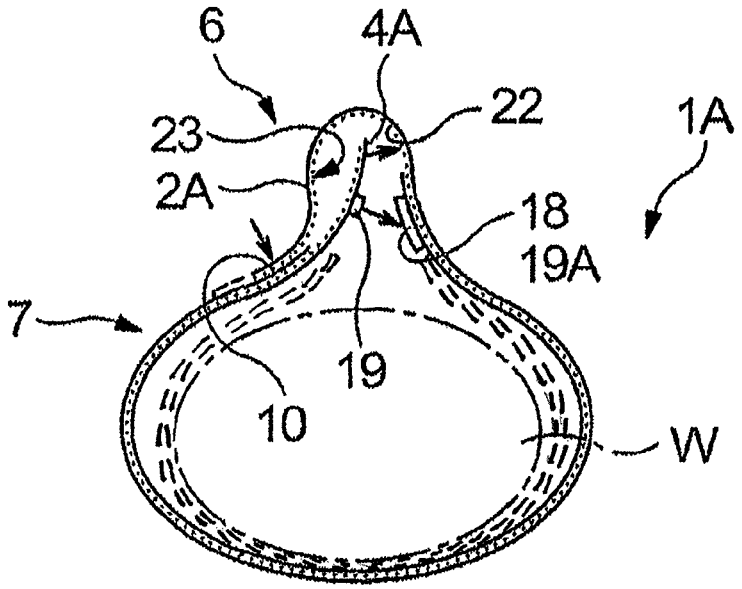
Fig. 6A
Fig. 6B
Fig. 6C
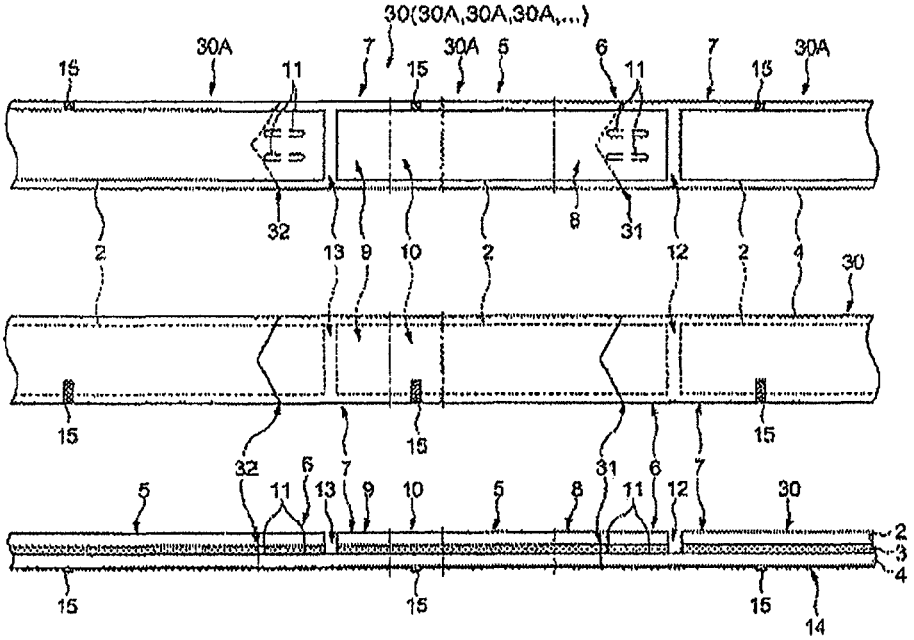

Fig. 11A
Fig. 11B
Fig. 11C
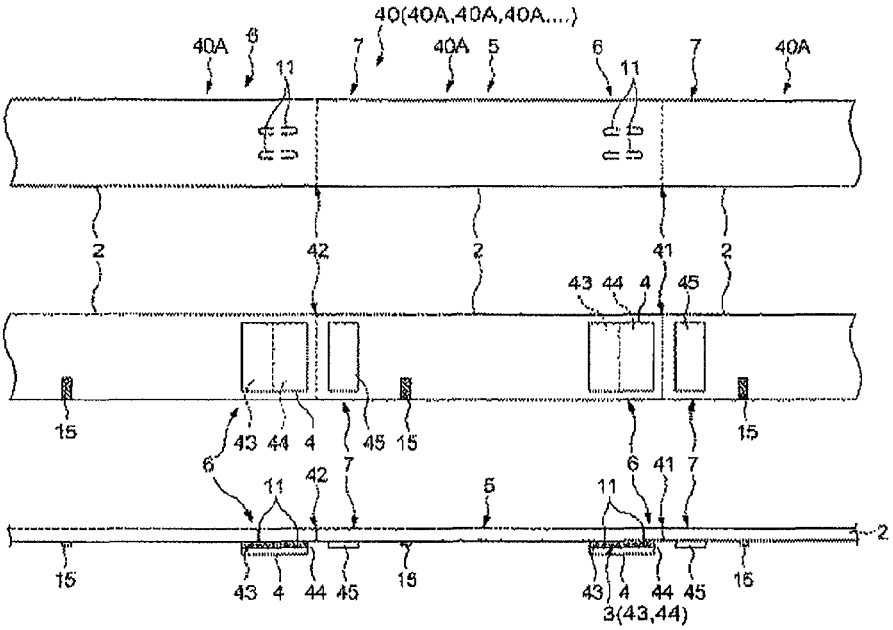
Fig. 12A
Fig. 12B
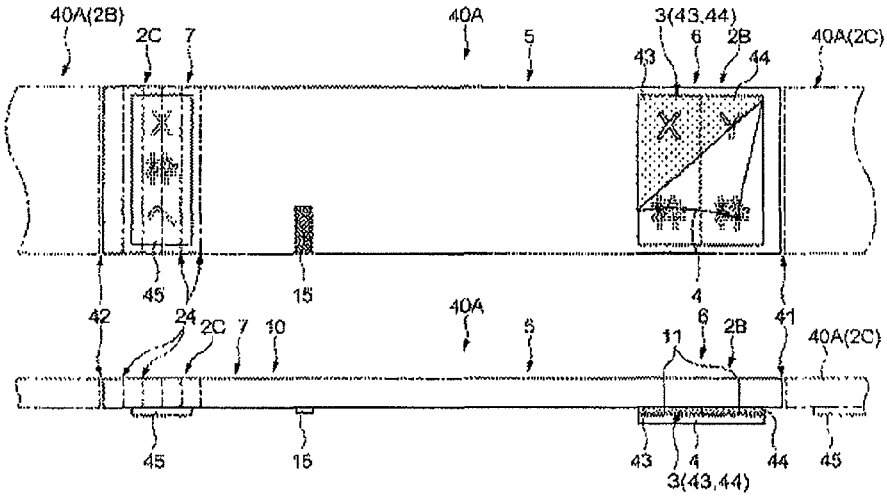

BAND AND METHOD FOR WINDING BAND

CROSS-REFERENCE TO RELATED APPLICATIONS

This application is a continuation of U.S. patent application Ser. No. 13/876,923, filed Mar. 29, 2013, which is a 35 U.S.C. §371 national phase conversion of PCT/JP2011/005867, filed Oct. 20, 2011, which claims priority of Japanese Application No. 2010-236490, filed Oct. 21, 2010 and Japanese Patent Application No. 2010-286377, filed Dec. 22, 2010, the contents of which are incorporated by reference herein. The PCT International Application was published in the Japanese language.

TECHNICAL FIELD

The present invention relates to a wristband, a continuous body of the wristbands and a method for winding the wristbands, wherein the wristbands are capable of identifying persons such as patients in a medical field or visitors in an amusement field by winding the wristbands around the wrists or ankles.

BACKGROUND ART

A wristband in a strip shape having an adhesive applied to a rear surface of its main body which is in a belt shape, and a mount temporarily attached to the main body is conventionally known. When it is in use, both ends of the main body are adhered with each other after peeling off a part of the mount and exposing the adhesive layer so as to wrap it around a wrist or the like in a ring shape. Then, the adhesive layer on the rear surface of one end is adhered to the front surface of the other end. Further, in at least one end portion, a notch portion is formed for preventing re-use or unauthorized use.

However, it is cumbersome for a user to wind a wristband that is in an elongate strip shape around a wrist or an ankle, as these are different in size depending on the user, on an appropriate position and in an appropriate size (or diameter). Particularly, it is difficult to ensure a proper form of the adhered wristband when the user winds the wristband by himself/herself alone and its workability is lowered. In addition, there is a problem that, when both ends are adhered to each other, both ends are easily shifted from each other because the wristband itself is elongated.

Further, there is also a problem that the above mentioned trouble, of being not able to ensure a proper form because it is cumbersome for the user to wind a wristband in an elongate strip shape around a wrist or an ankle, is likely to occur when both ends of a wristband in a label are adhered to each other. This is because the notch portion is not located at an adhesion portion (an overlapping portion) that is formed on both ends for preventing unauthorized use, and it is difficult to sufficiently fulfill the function of fracture (the function of unauthorized use), if both ends are not accurately, surely and carefully adhered to each other along a predetermined length when both ends of the wristband in a label are adhered.

In addition, in a continuous body or strip successively formed of a plurality of wristbands in one piece, each wristband in one piece is separated from other end portion thereof for use. In the wristband configured to be (temporarily) attached with a mount on the rear surface of a band base material, it is needed to peel off a part of the mount from the rear surface of the band base material so as to expose the adhesive layer after the wristband is separated in one piece. There is a problem that it takes time up to the preparation of the wristband in one piece, during which the wristband is actually formed in a ring shape by exposing the adhesive layer from a state of the continuous body of wristbands.

SUMMARY OF INVENTION

Technical Problem

The present invention is based on the above circumstances.

It is an objective of the present invention to provide a wristband, a continuous body of the wristbands and a method for winding the wristband, which are reliable for the operation of winding on a subject, such as a wrist or an ankle.

It is another objective of the present invention to provide a wristband, a continuous body of the wristbands and a method for winding the wristband, to ensure a proper and accurate form of the wristband wound in a ring shape.

It is another objective of the present invention to provide a wristband, a continuous body of the wristbands and a method for winding the wristband, in which both ends of the wristband are adhered with each other in a correct position such that a notch portion for preventing unauthorized use is exhibited to ensure its function.

It is another objective of the present invention to provide a wristband, a continuous body of the wristbands and a method for winding the wristband, in which a ring shape is formed immediately because a mount is already peeled off from the band base material when the wristband is separated from the continuous body of the wristbands.

Solution To Problem

The present invention is focused on adhering both rear surfaces first rather than adhering a rear surface of a band base material to a front surface thereof as is done in the prior art, and on dividing the operation of winding into two steps rather than completing the operation of winding the wristband in a ring shape around the subject in one step.

In a first aspect of the present invention, a wristband comprises: a band base material in a belt shape; an adhesive layer formed on a rear surface of the band base material; and a mount temporarily attached to and covering the adhesive layer. The band base material comprises: a central region capable of displaying specific information; a first winding region and a second winding region which are respectively located at the left and right ends of the central region so as to be wound around a subject of a wrist or an ankle together with the central region; and a first adhesion position guide and a second adhesion position guide disposed in the first winding region and the second winding region, respectively, wherein the adhesive layer is exposed when the mount located on the rear surface of the first winding region is peeled off, wherein the rear surface of the first winding region having the adhesive layer exposed is adhered to the rear surface of the second winding region to form a ring shape during winding the subject by overlapping the rear surfaces such that the first adhesion position guide and the second adhesion position guide are put together while a part of the adhesive layer remains to be possibly exposed, and wherein the first winding region having the part of the adhesive layer remaining partially to be possibly exposed is adhered to the front surface of the second winding region.

In a second aspect of the present invention, a wristband for being wound around a wrist or an ankle comprises: a band base material in a belt shape; an adhesive layer entirely formed on a rear surface of the band base material; and a mount in a belt shape temporarily attached to and covering the adhesive layer, wherein the adhesive layer is exposed when the mount located on the rear surface of one end portion of the band base material is peeled off, and wherein the mount is exposed when the band base material on the front surface of the other end portion thereof is peeled off.

In a third aspect of the present invention, a continuous body or strip has a plurality of wristbands according to the second aspect above, which body comprises: a band base material in a belt shape; an adhesive layer entirely formed on a rear surface of the band base material; and a mount in a belt shape temporarily attached to and covering the adhesive layer, wherein the strip of band base material is formed with a pair of band separation lines at a predetermined distance so as to form a wristband in one piece, wherein the mount is formed with a pair of mount separation lines at a predetermined distance. The pair of band separation lines is located at positions different from the pair of band separation lines, respectively, so that, in the wristband in one piece, the adhesive layer is exposed when the mount located in the rear surface of one end portion of the band base material is peeled off, and wherein the mount is exposed when the band base material in the front surface of the other end portion thereof is peeled off.

The band separation lines may be cuts for enabling separating to form the wristband in one piece. The band separation lines may be cuts for separating a strip to form each wristband in one piece and forms a distance for detecting position in a portion of the cuts.

In a fourth aspect of the present invention, a continuous body of wristbands, comprises: a band base material in a belt shape; an adhesive layer formed on a rear surface of the band base material; and a mount temporarily attached to and covering the adhesive layer. The band base material comprises: a central region capable of displaying specific information; a first winding region and a second winding region respectively located at the left and right ends of the central region so as to be wound around a subject of a wrist or an ankle together with the central region. The band base material is formed with a first band separation line and a second band separation line to form a wristband in one piece. The mount is formed with a first mount separation line and a second mount separation line to form the wristband in one piece, the first mount separation line and the second mount separation line are located at positions different from the first band separation line and the second band separation line. In the one piece wristband, the adhesive layer is exposed when the mount at the rear surface of the first winding region is peeled off, and wherein the mount is exposed when the band base material at the front surface of the second winding region is peeled off.

In a fifth aspect of the present invention, a method for winding a wristband uses a band base material in a belt shape, an adhesive layer formed on a rear surface of the band base material; and a mount temporarily attached to and covering the adhesive layer. The band base material comprises: a central region capable of displaying specific information; a first winding region and a second winding region respectively located in the left and right ends of the central region so as to be wound around a subject of a wrist or an ankle together with the central region a first adhesion position guide and a second adhesion position guide disposed at the first winding region and the second winding region, respectively. The method comprises: an exposure step for exposing the adhesive layer by peeling off the mount located in the rear surface of the first winding region, a first adhesion step of forming the wristband in a ring shape so as to be wound around a subject by adhesively overlapping the rear surface of the first winding region having the adhesive layer exposed and the rear surface of the second winding region such that a first adhesion position guide and a second adhesion position guide are brought to each other in a state where a part of the adhesive layer remains to be possibly exposed, and a second adhesion step of adhering the first winding region having the adhesive layer partially remaining partially to be possibly exposed to the front surface of the second winding region.

The adhesive layer may be defined into a first adhesion region to be adhered to the rear surface of the first winding region and a second adhesion region to be adhered to the surface of the second winding region.

At least one of the first winding region and the second winding region may be formed with a notch portion for causing fracture of the wristband there.

The first adhesion position guide and the second adhesion position guide may be adhesion position marks printed in advance at the first winding region and the second winding region, respectively. The first adhesion position guide or the second adhesion position guide may alternatively be an adhesion position guide fragment formed in advance in the first winding region or the second winding region.

The mount may be in direct contact with the subject such as a wrist or ankle. The band base material may be in direct contact with the subject.

The mount may be comprised of a transparent material. The first adhesion position guide and the second adhesion position guide may be disposed on the rear surface of the mount. The mount may be comprised of a transparent material and is formed with at least one of the first adhesion position guide and the second adhesion position guide on the rear surface thereof.

The mount located in the second winding region may protrude off the band base material from an end portion of the second winding region toward the opposite side of the first winding region.

The adhesive layer and the mount may be disposed only on the rear surface of the first winding region.

The band base material of the second winding region may be formed with a plurality of perforations parallel to each other in a width direction.

The first winding region may have on at least one of the front surface and the rear surface thereof an advertisement column in advance printable of advertisement information on the wristband.

Advantageous Effects of Invention

In a wristband, a continuous body of wristbands and a method for winding a wristband according to the present invention (a first aspect, a fourth aspect and a fifth aspect), since a first adhesion position guide and a second adhesion position guide are provided in a first winding region and a second winding region, respectively, and rear surfaces of both ends of a band base material in a belt shape are adhered to each other, the user can easily and surely wind it around a wrist and the like even while the user is alone. Also, since the rear surfaces of the first winding region and the second winding region are adhered, and since a rear surface of the first winding region is adhered to a front surface of the second winding region, the user can wind the wristband in a ring shape just to fit the size of the user's wrist or ankle.

In particular, in the first aspect of the present invention, a first adhesion position guide and a second adhesion position guide are provided in the first winding region and the second winding region, respectively. The rear surface of the first winding region has an exposed adhesive layer and the rear surface of the second winding region is adhesively overlapped to possibly form a ring shape to be wound around a subject such that the adhesion position guide and the second adhesion position guide are adhered on each other in a state where a part of the adhesive layer remains to be possibly exposed. Then, since the first winding region, which has the adhesive layer remaining partially to be possibly exposed, can be adhered to the front surface of the second winding region, it is easy for the user to adhere both end portions of the wristband by winding with one hand.

In particular, according to the second aspect of the present invention, the adhesive layer can be exposed after the mount is peeled off from the rear surface of one end portion of the band base material, and the mount is also exposed after the band base material has been peeled off on the front surface of the other end portion of the band base material. Since it is not needed to peel off the mount, the wristband can be wound around the subject such as a wrist and the like by immediately adhering the end portion of the mount side to the end portion of the adhesive layer side and forming in a ring shape.

In particular, according to a continuous body of wristbands in the third aspect of the present invention, a band base material is formed with a pair of band separation lines at a predetermined distance in order to form a wristband in one piece, a mount is formed with a pair of mount separation lines at a predetermined distance at a place different from the band separation lines, respectively, and an adhesive layer which is possibly exposed by peeling off the mount in the rear surface of one end portion the band base material, and the mount is possibly exposed by removing the band base material in the front surface of the other end portion of the band base material. Then, since the mount in the most end portion of the continuous body of wristbands is already in a single layer by separating the preceding wristband for use, the next wristband (the most end portion of the continuous body of wristbands above) can be obtained in one piece by peeling off only the band base material upstream from the mount, and workability is excellent.

In particular, according to a continuous body of wristbands in the fourth aspect of the present invention, a first band separation line and a second band separation line formed in the band base material are located at locations different from a first mount separation line and a second mount separation line formed in the mount, respectively. Also, an adhesive layer is possibly exposed by peeling off the mount in the rear surface of the winding region, and the mount is possibly exposed by removing the band base material in the front surface of the second winding region. Then, since the mount in the most end portion of the continuous body of wristbands is already in a single layer by separating the preceding wristband for use, similar to the third aspect as above, the next wristband (the most end portion of the continuous body of wristbands above) can be obtained in one piece by peeling off only the band base material upstream from the mount, and workability is excellent.

In particular, according to a method of winding a wristband in the fifth aspect of the present invention, the method comprises the steps of exposing the adhesive layer by peeling off a mount in a rear surface of a first winding region, a first adhesion step of forming the wristband into a ring shape so as to be wound around a subject by adhesively overlapping the rear surface of the first winding region having the adhesive layer exposed and the rear surface of the second winding region such that a first adhesion position guide and a second adhesion position guide are applied to each other in a state where a part of the adhesive layer remains to be possibly exposed, and a second adhesion step of adhering the first winding region having the adhesive layer remaining partially to be possibly exposed to the front surface of the second winding region. Then, a ring in a maximum diameter can be formed in the first adhesion step, the winding in a ring shape can be according to a size appropriate to the subject of the user in the second adhesion step, and further it is easy to secure finally from a maximum diameter.

BRIEF DESCRIPTION OF DRAWINGS

FIG. 1A is a plan view of a continuous body or strip 1 of wristbands according to a first example of the present invention, FIG. 1B is a rear view, and FIG. 1C is a cross sectional view thereof, respectively.

FIG. 2A is a rear view of a wristband 1A according to a first example of the present invention and FIG. 2B is a cross sectional view thereof, respectively.

FIG. 5 is a cross-sectional view of a second adhesion step of adhering a rear surface of the first winding region 6 to a front surface of the second winding region 7.

FIG. 6A is a plan view of a continuous body 30 of wristbands according to the second example of the present invention, FIG. 6B is a rear view, and FIG. 6C is a cross sectional view, thereof, respectively.

FIG. 11A is a plan view of a continuous body 40 of wristbands according to a third example of the present invention, FIG. 11B is a rear view, and FIG. 11C is a cross sectional view thereof, respectively.

FIG. 12A is a rear view of a wristband 40A according to the third example of the present invention and FIG. 12B is a cross sectional view thereof, respectively.

DESCRIPTION OF EMBODIMENTS

Figure 3:
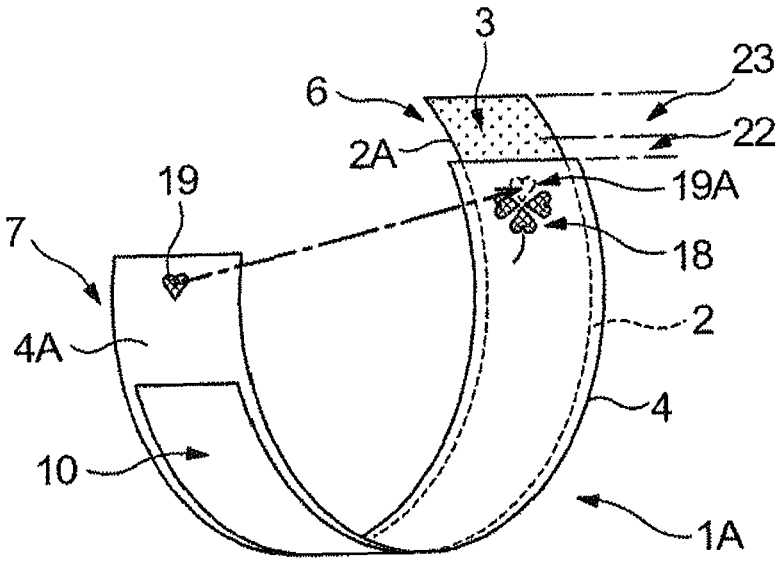
FIG. 3 is a perspective view of a first stage of winding a wristband 1A in a ring shape after the band is separated from a continuous body 1 of wristbands.

The present invention has achieved a wristband, a continuous body of wristbands and a method of winding a wristband in which in a ring shape is easily and reliably achieved even on a winding subject of different sizes, and adhering between the rear surface of both ends of the base band strip, to be divided into two times the operating winding.

EXAMPLES

FIGS. 1A to 5 show a wristband, a continuous body of wristbands and method for winding a wristband according to a first example of the present invention. The continuous body 1 of wristbands comprises a plurality of the wristband 1A successively in a one piece strip. The continuous body 1 of wristbands (the wristband 1A), as shown in FIG. 1C, comprises a band base material 2 in a strip shape, an adhesive layer 3 formed entirely on a rear surface of the band base material 2, and a mount 4 in a strip shape temporarily attached to the adhesive layer 3 to cover it.

The band base material 2 comprises a synthetic paper which is based on, for example, polypropylene (PP), polystyrene (PS), polyethylene (PE) and the like, mixed with or coated with a white pigment. By providing the base material 2 with opacity, fitness for printing and smoothness, the band base material 2 is excellent for weather resistance, water resistance and printability. The band base material 2, as shown in FIG. 1A, has a central region 5 located at the center substantially in a longitudinal direction of the wristband 1A, and a first winding region 6 and a second winding region 7 located respectively at the right and left ends of the central region 5, which are capable of being wound around a subject W such as a wrist or ankle (FIGS. 4 and 5) in conjunction with the central region 5. The central region 5 is printable with specific information to identify patients or visitors, using bar codes or any other means such as characters or symbols, and further, if necessary, an IC chip (not shown) capable of storing more information.

In addition to the central region 5 being printable with "specific information", an advertisement column 8, in which "advertisement information" is possibly printed in advance, may be provided on the first winding region 6. Further, a usage column 9, including "usage information (how to wind this around a wrist and the like)" is possibly printed in advance on the second winding region 7. Depending on usage patterns of the wristband 1A, a printing position, including a case of printing in advance, of the above information on the first winding region 6 and the second winding region 7 may be provided. For example, the advertisement column 8 may be provided on the central region and the specific information may be printed on the first winding region 6. Alternatively, the advertisement column 8 may be provided on the second winding region 7. Advantageously, advertising effects can be obtained more reliably and efficiently, when the advertisement column 8, is possibly printed in advance and provided on at least one of a front surface and a rear surface of the first winding region 6. For example, when the advertisement column 8 is provided on a front surface of the first winding region 6, as described below for FIGS. 4 and 5, a user (an operator of winding) sees a front surface of the first winding region 6 in a second step of adhering and then sees advertisement information. Alternatively, when the advertisement column 8 is provided on a rear surface (a rear surface of the adhesive layer 3 or a rear surface of the mount 4) of the first winding region 6, as described below for FIGS. 3 and 4, a user (an operator of winding) sees a rear surface of the first winding region 6 in a first step of adhering and then sees advertisement information. When the advertisement column 8 is provided in advance on a rear surface of the first winding region 6, advertisement information in the advertisement column 8 may be designed in combination with a first adhesion position mark 18, or a second adhesion position mark 19A in a broken line (a first adhesion position guide) and a second adhesion position mark 19 in a broken line (a second adhesion position guide) (as described below for FIGS. 1B and 2A). Further, an adhesion range printing column 10, in which "adhesion range" (as described for FIGS. 4 and 5) is possibly printed in advance, may also be provided on the right side in FIGS. 1A, 1B, and 1C of the usage printing column 9 of the second winding region 7 (on an upstream side in a transport direction R of the continuous body 1 of wristbands), and as a result a finally desired adhesion range of the second adhesion range 23 (as described for FIG. 4) may be shown.

In the band base material 2, a notch portion 11 for enabling fracture is formed in the first winding region 6. The notch portion 11 is preferably a cut in any shape with notch ends directed toward the upstream side and the downstream side of the continuous body 1 of wristbands (the wristband 1A). When there is an attempt to peel off a wristband incorrectly in either direction after the adhesion of the first winding region 6 and the second winding region 7, the notch portion 11 makes it difficult to recover the original condition because at least one of the first winding region 6 and the second winding region 7 is fractured. Of course, the notch portion 11 for fracture may be formed in at least one of the first winding region 6 and the second winding region 7 to be adhered to each other eventually.

The band base material 2 is formed with a first band separation line 12 and a second band separation line 13 to form a wristband 1A in one piece. An example is shown in which the wristband 1A in one piece is possibly detached by forming weakened portions between a plurality of wristbands 1A. The portions may be configured to detach the wristband 1A in one piece by forming perforations or cuts for separation between a plurality of wristbands 1A.

The adhesive layer 3 comprises any type having adhesiveness or cohesiveness in strength as required, and preferably is an ordinary paste or a strengthened paste. By applying non-adhesive ink and the like on the edges 3A (edges on the upstream side, in FIG. 1C) in a width direction of the adhesive layer 3 in contact with the first band separation line 12 in the first winding region 6, it makes it easy to peel off the band base material 2 and the mount 4 from the above edges in a width direction.

The mount 4 is formed of a transparent material and the like such as a relatively thin film which has the strength required. The mount 4 has an embossed surface 14 on its rear surface to ensure proper breathability at a wearer's skin even when in direct contact with skin, so that there is no uncomfortable feeling when installed. A position detection mark 15 (FIG. 1B) is printed in advance on a rear surface of the mount 4. When the continuous body 1 of wristbands having a plurality of wristbands 1A successively disposed is installed in a printer (not shown) and transported toward the transport direction R (FIG. 1A) shown by an arrow, the position detection mark 15 is detected with any sensor (not shown). Specific information and the like may be printed at a predetermined position in the central region 5.

The mount 4 is possibly separated together with its wristband 1A by a first mount separation line 16 and a second mount separation line 17. These may be cuts for separation formed at positions different from the first band separation line 12 and the second band separation line 13 along the band base material 2. As shown in FIG. 2B, when the wristband 1A is separated from the continuous body 1 of wristbands, the mount 4 of the second winding region 7 is off the band base material 2 and protrudes toward the opposite side from the first winding region 6 in an end portion of the second winding region 7, namely toward the downstream side in the transport direction R and in a single layer. In other words, the band base material 2 is formed with the first band separation line 12 and the second band separation line 13 so as to form the wristband 1A in one piece, and the mount 4 is formed with the first mount separation line 16 and the second mount separation line 17 so as to form the wristband 1A in one piece at positions different from the first band separation line 12 and the second band separation line 13, respectively. Further, in the wristband 1A in one piece, the adhesive layer 3 is possibly exposed by peeling off the mount 4 from the rear surface of the first winding region 6, and the band base material 2 having the adhesive layer 3 is exposed in a band base material 2A in a single layer. In addition, the mount 4 is possibly exposed by removing the band base material 2 in the front surface of the second winding region 7, and the mount 4 exposed is a mount 4A in one piece.

The mount 4 is made of a transparent material as described above, in particular as shown in FIGS. 1B and 2A. On the rear surface thereof, the mount is formed with a first adhesion position mark 18 (a first adhesion position guide) and a second adhesion position mark 19 (a second adhesion position guide) in the first winding region 6 and the second winding region 7, respectively. In an example shown in FIGS. 2A and 2B, designing a four-leaf clover, the first adhesion position mark 18 is drawn as an incomplete four-leaf clover having three leaves and a stem, and the second adhesion position mark 19 is drawn as a remaining fourth leaf. Specifically, a second adhesion position mark 19A in a dotted line is drawn at a position in the first adhesion position mark 18 to be adhered with the second adhesion position mark 19. Since the mount 4 is transparent, the user can see through the first adhesion position mark 18 to see the second adhesion position mark 19, and the second adhesion position mark 19A in a dotted line from either the front surface or the rear surface.

The first adhesion position guide and the second adhesion position guide may be printed in advance on the first winding region 6 and the second winding region 7. Any design can be employed as these marks, for example, a simple "circle, cross or triangle", also a tally that makes sense in pairs, something like a pair at different concentrations in the same shape, and something capable of advertising, etc.

Forming a band removal notch 20 and a mount removal notch 21 in half-cut, perforation and the like in the band base material 2 and the mount 4, facilitates removal by fracture after regular use. However, it is desirable to keep shifting positions of half-cut or perforation in the band base material 2 and the mount 4.

Figure 4:
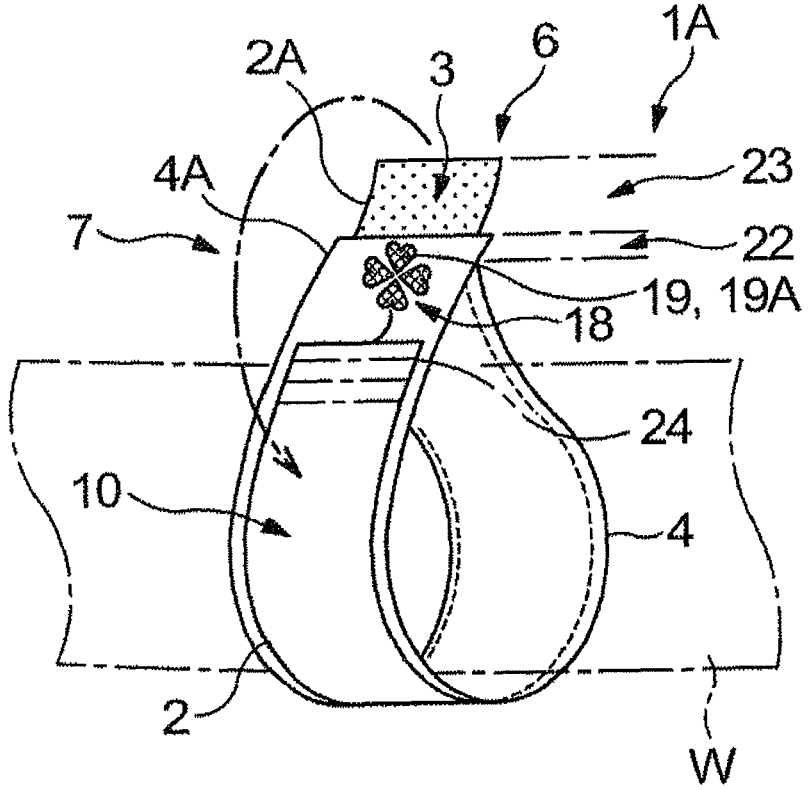
FIG. 4 is a perspective view of a first adhesion step of adhering a rear surface of the first winding region 6 to a rear surface of the second winding region 7.
Figure 7A:
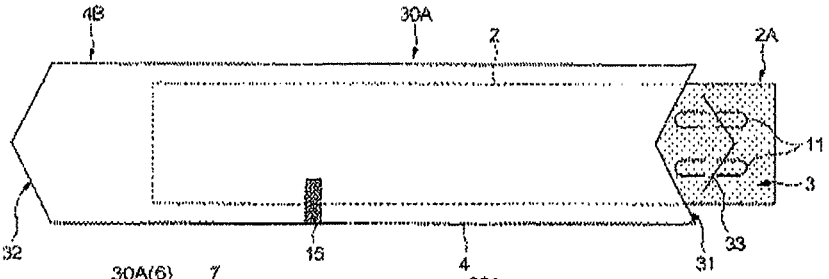
FIG. 7A is a rear view of a wristband 30A according to the second example of the present invention and FIG. 7B is a cross sectional view thereof, respectively.
Figure 7B:
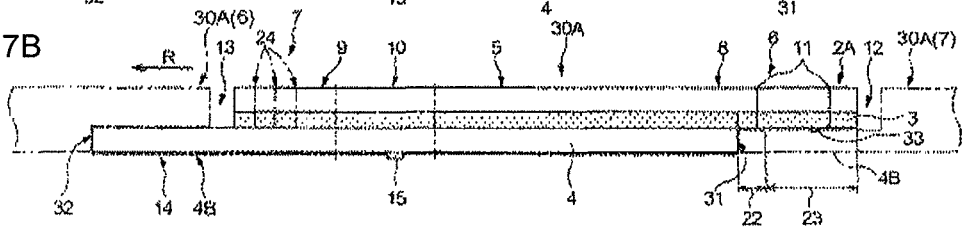

FIGS. 3 to 5 describe how to operate in winding the continuous body 1A (the wristband 1A) in configuration as above around a subject W. FIG. 3 illustrates a first stage of winding a wristband 1A in a ring shape separated from a continuous body 1 of wristbands. The mount 4 on the rear surface of the first winding region 6 is peeled off to expose the adhesive layer 3 (a step of exposing). Since the wristband 1A has been separated before that peeling, the mount 4 namely the mount 4A in a single layer located at the tip portion (a front end of the most downstream side) of the continuous body 1A of wristbands is already separated from the band base material 2 (the band base material 2A in a single layer) in a upper layer side thereof. Therefore, there is no need to peel off the band base material 2 from the mount 4 at the downstream side, and the wristband 1A in the state shown in FIGS. 2 and 3 can be easily obtained by peeling off the band base material 2 from the mount 4 in the first band separation line 12 of the band base material 2 at the upstream side. In the state shown in FIG. 3, the second adhesion position mark 19 in the second winding region 7 is adhered toward the direction (an arrow shown in FIG. 3) of the first adhesion position mark 18 in the first winding region 6.

FIG. 4 illustrates a first step of adhering a rear surface of the first winding region 6 to a rear surface of the second winding region 7. The second adhesion position mark 19 in the second winding region 7 (the mount 4A in a single layer) is adhered to the first adhesion position mark 18 (more specifically, the second adhesion position mark 19A in a dotted line) so as to complete the design of a four-leaf clover, and the tip of the mount 4A in a single layer is adhered to the adhesive layer 3 of the band base material 2A in a single layer. However, in the first adhesion step, since the mount 4A (the mount 4) in a single layer is transparent, it is possible to see through the second adhesion position mark 19 on the rear surface thereof. At least one of the first adhesion position mark 18 (the first adhesion position guide) and the second adhesion position mark 19 (the second adhesion position guide) is on the adhesive layer 3. For example, the first adhesion position mark 18 and the second adhesion position mark 19A in a dotted line marks in the first winding region 6 can be printed directly on the adhesive layer 3 instead of on a rear surface of the mount 4, such that the first adhesion position mark 18 and the second adhesion position mark 19A in a dotted line can be seen through the mount 4 of the lower side in the part printed and the mount 4 in a single layer 4, since the mount 4 of the lower side in the part printed is transparent.

In the first adhesion step, particularly as shown in FIGS. 2B and 4 (further, FIG. 5), the adhesive layer 3 is possibly defined into a first adhesion region 22 to be adhered with a rear surface of the second winding region 7 and a second adhesion region 23 to be adhered with a front surface of the second winding region 7. In short, the mount 4 on the rear surface of the first winding region 6 (the mount 4A to be in a single layer on the upstream side when the wristband 1A is in use) is peeled off to expose the adhesive layer 3. The rear surface of the first winding region 6 having the adhesive layer exposed and the rear surface of the second winding region 7 are possibly formed in a ring shape to wind it around the subject W by adhesively overlapping both rear surfaces such that the first adhesion position mark 19 and the second adhesion position mark 19A are put together with each other while leaving a part (a second adhesion region 23) of the adhesive layer 3 to be possibly exposed.

Further, in the first adhesion step, the wristband 1A can be formed in a ring shape regardless of the subject W and at a place away from the subject W. It is possible for the user to perform the above operation with both hands in winding the wristbands 1A alone, and thus the user can avoid doing cumbersome and inaccurate operation where the wristband 1A is wound around one wrist and the first winding region 6 and the second winding region 7 are adhered using the other hand. Furthermore, with the first winding region 6 and the second winding region 7 as shown in FIG. 4, the wristband 1A in a ring shape has substantially a maximum diameter or a maximum size. The subject W, such as a wrist or an ankle, which varies in size based on the user, can easily pass through the ring shape.

FIG. 5 illustrates a second adhesion step of adhering a rear surface of the first winding region 6 to a surface of the second winding region 7. While the subject W is inserted into the wristband 1A (FIG. 4) formed in a ring shape in the first adhesion step, the first winding region 6 having the adhesive layer 3 (the second adhesion region 23) remains partially to be possibly exposed on the rear surface of the first winding region 6 and that region is adhered to the front surface of the second winding region 7 completing the winding to the subject W. In particular, as shown by each arrow in FIG. 5, the second adhesion position mark 19 of the mount 4 in a single layer in the second winding region 7 is put together with the first adhesion position mark 18 and the second adhesion position mark 19A in a dotted line in the first winding region 6. The mount 4A in a single layer is adhered to the first adhesion region 22 in the first winding region 6 (the adhesive layer 3). Further, the band base material 2A in a single layer in the first winding region 6 is adhered to an arbitrary position in the adhesion range printing column 10 of the second winding region 7 via the second adhesion region 23. In addition, the work of adhering the band base material 2A in a single layer to the adhesion range printing column 10 is done by the user with one hand, but it can be done easily and accurately since the wristband 1A having predetermined rigidity has been already formed in a ring shape by adhering properly and accurately both ends thereof.

Therefore, in the first adhesion step as shown in FIG. 4, the wristband 1A can be adhered in a ring shape so as to obtain a maximum diameter of substantially constant size with respect to the subject W, namely, the size of the ring made by the wristband 1A can be kept constant, and then, in the second adhesion step as shown in FIG. 5, the wristband 1A can be adhesively secured in a ring shape while adjusting the diameter appropriate to the subject W varying in size to complete the winding. In FIG. 5, dotted lines indicate an alternative arbitrary position at which band base material 2A is adhered to the adhesion range printing column 10 of the second winding region 7 via the second adhesion region 23, thereby adjusting the diameter of wristband 1A, that adjusted diameter being indicated by dotted lines showing a portion of wristband 1A.

In addition, by forming a plurality of perforations 24 (imaginary lines in FIGS. 2B and 4) parallel to each other in the width direction, the band base material 2 in the second winding region 7 may be lowered in rigidity, or the band base material 2 may be provided with flexibility, so as to fit a ring state, where the band base material 2 is doubled over in the inner side of the wristband 1A formed in the second adhesion step, to the subject W.

Thus, the mount 4 with embossment 14 is possibly in direct contact with the subject W during use, and can be used as it is without throwing it away. In addition, it is possible to wind the wristband 1A having a size appropriate to the size of the subject W. When, for example, the user himself/herself applies the wristband by himself, the operation of winding can be carried out with both hands in the first adhesion step to ensure proper adhesion position or range, so that an adhesion state or an adhesion posture to an incorrect position significantly deviated from the proper position can be avoided.

Next, FIGS. 6A to 10 show a wristband, a continuous body of the wristbands and method for winding the wristband according to a second example of the present invention. In the following description, only parts that are different from the first example are described, and omitted are details of the parts similar thereto by allocating the same reference signs. The continuous body 30 of wristbands and the wristband 30A differ from the continuous body 1 of wristbands and the wristband 1A (FIGS. 1A to 5) at the structures at both ends of the mount 4, that is, the first adhesion position guide (a bend line 33 in a chevron shape) and the second adhesion position guide (a mount 4B in a single layer having a tip portion in a triangular or chevron shape). That is, the wristband 30A is obtained in one piece by forming the band base material 2 to have the first separation line 12 and the second separation line 13 in the same manner to the continuous body 1 of wristbands and the wristband 1A, and a first mount separation line 31 in a chevron shape corresponding to the first mount separation line 16 and a second mount separation line 32 in a chevron shape corresponding to the second mount separation line 17 in the continuous body 1 of wristbands.

Therefore, the mount 4 located on the opposite side (the downstream side) of the band base material 2A in a single layer becomes the mount 4B in a single layer having the end portion in a triangle shape. The first adhesion position guide corresponding to the mount 4B in a single layer is printed in advance on the adhesive layer 3 of the band base material 2 in a single layer as the bend line 33 in a chevron shape in place of the first adhesion position mark 18 in the wristband 1A. Conversely speaking, the second adhesion position guide corresponding to the first adhesion position guide (the bend line 33 in a chevron shape) in the first winding region 6 is the mount 4B in a single layer having the end portion in a chevron shape as a adhesion position guide fragment formed in advance in a predetermined form (in an example shown in FIG. 8, the end portion in a chevron shape, for example) in the second winding region 7. Of course, the band base material 2A in a single layer may be formed with the end portion in a triangular shape similar to the mount 4 in a single layer to be the first adhesion position guide fragment instead of forming the bend line 33 in a chevron shape in the first winding region 6. By configuring the first adhesion position guide and the second adhesion position guide as adhesion position guide fragments such as the mount 4B in a single layer having the end portion in a triangular shape, there is no possibility of disappearing by wearing away, unlike the first adhesion position mark 18, the second adhesion position mark 19 or the second adhesion position mark 19A which are printed in advance on the rear surface of the mount 4 in the first example (FIG. 1B) as described above.

Figure 8:
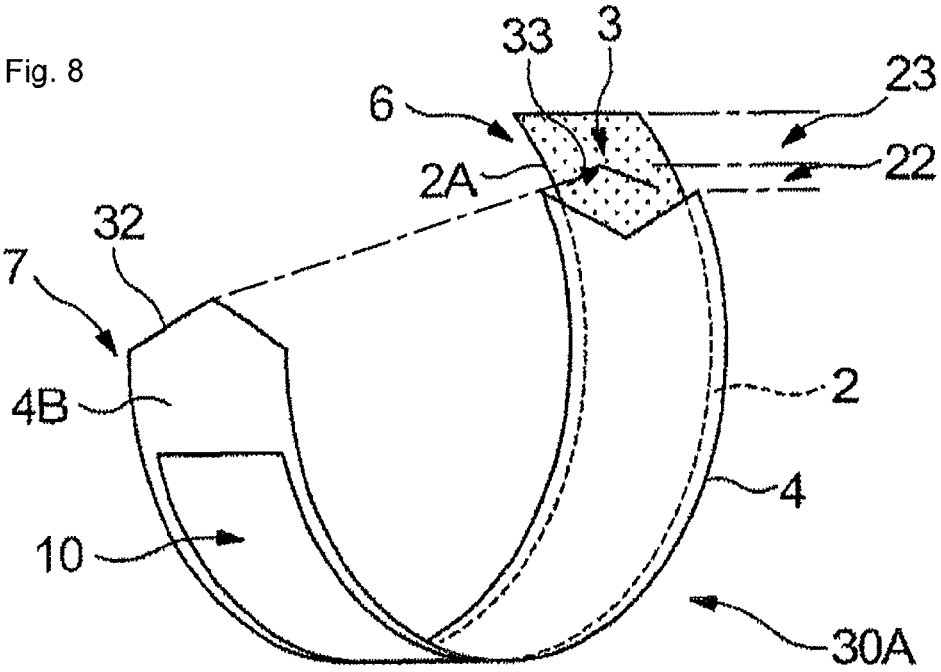
FIG. 8 is a perspective view of a first stage of winding a wristband 30A separated from a continuous body 30 of wristbands.
Figure 9:
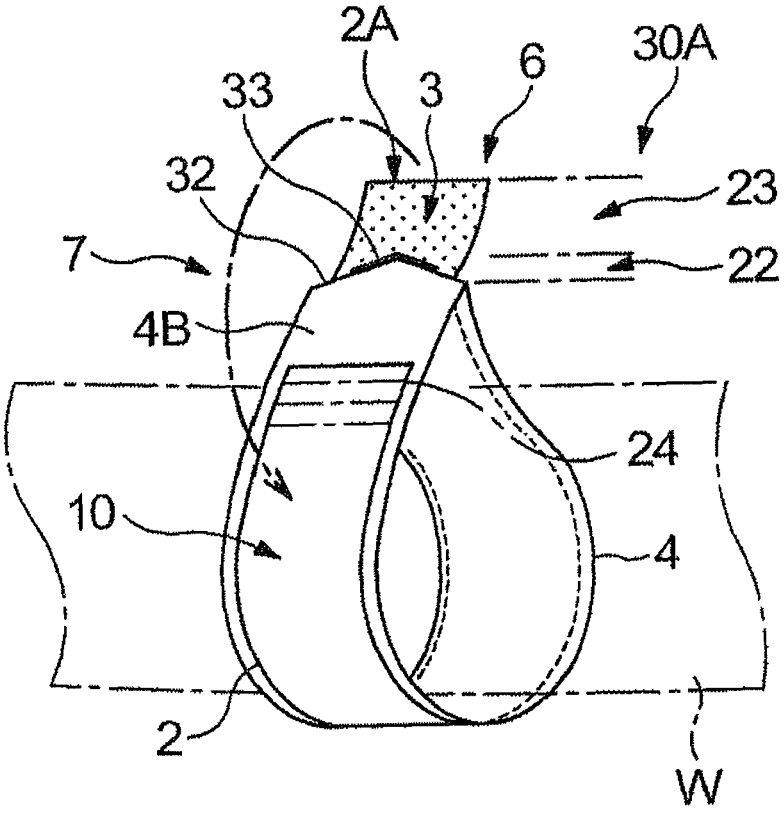
FIG. 9 is a perspective view of a first adhesion step of adhering a rear surface of the first winding region 6 to a rear surface of the second winding region 7.
Figure 10:
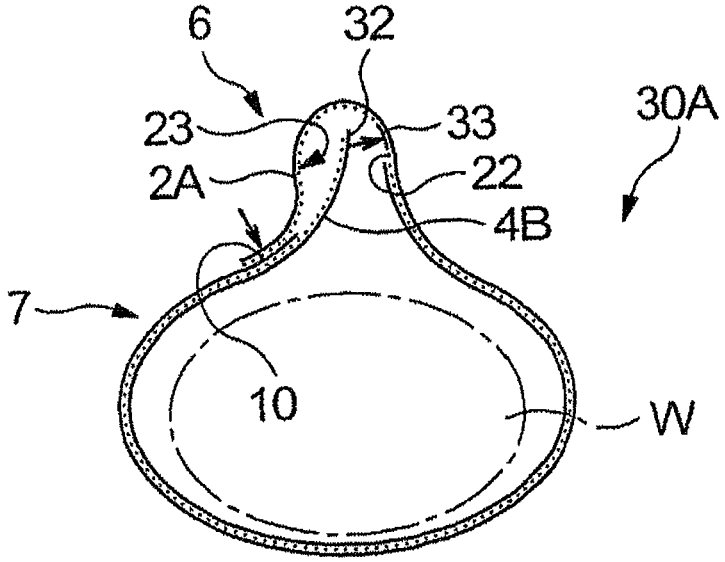
FIG. 10 is a cross-sectional view of a second adhesion step of adhering a rear surface of the first winding region 6 to a surface of the second winding region 7.

FIGS. 8 to 10 show winding the wristband 30A separated from the continuous body 30 in configuration as above around the subject. FIG. 8 is a perspective view illustrating a first stage of winding the wristband 30A in one piece separated from the continuous body 30 of wristbands. The mount 4 on the rear surface of the first winding region 6 is peeled off to expose the adhesive layer 3 (an exposure step) in the same manner as the continuous body 1 of wristbands and the wristband 1A. In the state shown in FIG. 8, the mount 4B in a single layer in the second winding region 7 is adhered toward the direction (an arrow shown in FIG. 8) of the bend line 33 in a chevron shape in the first winding region 6.

FIG. 9 is a perspective view illustrating a first adhesion step of adhering a rear surface of the first winding region 6 to a rear surface of the second winding region 7. The end portion in a triangular shape of the mount 4B in a single layer in the second winding region 7 is adhered to the bend line 33 in a chevron shape in the first winding region 6, and the end side of the mount 4B in a single layer is adhered to the adhesive layer 3 of the band base material 2A in a single layer. However, in the first adhesion step, since the mount 4B (the mount 4) in a single layer is transparent, it is possible to see through the end portion of the mount 4B in a single layer even when the end portion overlaps slightly the bend line 33 in the rear surface of the band base material 2A.

In short, the mount 4 (the mount 4B to be in a single layer on the upstream side when the next wristband 30A is in use) on the rear surface of the first winding region 6 is peeled off to possibly expose the adhesive layer 3. The rear surface of the first winding region 6 having the adhesive layer 3 exposed and the rear surface of the second winding region 7 are possibly formed in a ring shape to wind around the subject W by adhesively overlapping both rear surfaces such that the bend line mark 33 (the first adhesion position guide) and the end portion of the mount 4B (the second adhesion position guide) in a single layer are put together with each other while leaving a part (a second adhesion region 23) of the adhesive layer 3 possibly exposed. In the first adhesion step, since the mount 4B in a single layer has merely an edge portion in a predetermined shape, it is easy to put it on the bend line 33 in a chevron shape.

Further, in the first adhesion step, the wristband 30A can be formed in a ring shape regardless of the subject W and at a place away from the subject W in the same manner as the wristband 1A in the first example. The user may avoid a cumbersome operation of winding the wristband 1A alone and to make the wristband 1A in a ring shape to substantially a maximum diameter or a maximum size as designed.

FIG. 10 is a cross-sectional view illustrating a second adhesion step of adhering a rear surface of the first winding region 6 to a front surface of the second winding region 7. In this step, in a state where the subject W is inserted into the wristband 30A (FIG. 9) formed in a ring shape in the first adhesion step, the first winding region 6 having the adhesive layer 3 (the second adhesion region 23) remains partially possibly exposed on the rear surface of the first winding region 6 and is adhered to the front surface of the second winding region 7 so as to complete the winding to the subject W. In particular, as shown by each arrow in FIG. 10, the end portion of the mount 4B in a single layer in the second winding region 7 is put on the bend line 33 in a chevron shape in the first winding region 6. The mount 4B in a single layer is adhered to the first adhesion region 22 in the first winding region 6 (the adhesive layer 3). Further, the band base material 2A in a single layer in the first winding region 6 is adhered to the adhesion range printing column 10 of the second winding region 7 via the second adhesion region 23.

Therefore, in the first adhesion step as shown in FIG. 9, the wristband 30A can be adhered in a ring shape so as to obtain a maximum diameter with respect to the subject W, and then, in the second adhesion step as shown in FIG. 10, the wristband 30A can be adhesively secured in a ring shape while adjusting the diameter appropriate to the subject W varying in size to complete the winding.

Thus, the mount 4 with embossment 14 is possibly in direct contact with the subject W. Further, it is possible to wind the wristband 30A having a size appropriate to the size of the subject W. When, for example, the user carries out operation of winding by himself/herself alone, that can be done with both hands in the first adhesion step to ensure a proper adhesion position or range, so that an adhesion state or an adhesion posture to an incorrect position significantly deviated from the proper position can be avoided.

Next, FIGS. 11A to 15 show a wristband, a continuous body of the wristbands and a method for winding the wristband according to a third example of the present invention. FIG. 11A is a plan view of a continuous body 40 of wristbands, FIG. 11B is a rear view and FIG. 11C is a cross sectional view thereof, respectively. FIG. 12A is a rear view of a wristband 40A according to the third example of the present invention and FIG. 12B is a cross sectional view thereof, respectively. The difference in configurations of the continuous body 40 of wristbands and the wristband 40A in FIGS. 11A-15 from the continuous body 1 of wristbands and the wristband 1A (the first example, FIGS. 1A to 5) and the continuous body 30 of wristbands and the wristband 30A (the second example, FIGS. 6A to 10) is as follows. The continuous body 40 of wristbands and the wristband 40A do not have the mount 4 in a belt shape. More precisely, the mount 4 is provided on just a part of the rear surface of the first winding region 6, as described below. Therefore, the band base material 2 can be in direct contact with the subject W, and the band base material 2 is possibly separated by a first band separation line 41 and a second separation line 42 in perforation and the like, and other structures associated with these structures.

First, in the continuous body 40 of wristbands (the wristband 40A), the band base material 2 includes an upstream band base material 2B in the first winding region 6 located upstream of the central area 5 and a downstream band base material 2C in the second winding region 7 located downstream thereof. The adhesive layer 3 and the mount 4 are in a rectangular shape and are provided only on the rear surface of the upstream band base material 2B. The adhesive layer 3 in the rear surface of the upstream band base material 2B is formed only on a part of the first winding region 6. In particular, as shown in FIG. 12A, a first adhesion region 43 (a first adhesion position guide represented by "frame X" in FIG. 12A) and a second adhesion region 44 (represented by "frame Y" in FIG. 12A) adjacent to the first adhesion region 43 are provided as regions corresponding to the first adhesion position mark 18 and the second adhesion position mark 19A in a dotted line in the first winding region 6 (FIG. 2A). On the other hand, an adhesion position mark 45 (a second adhesion position guide) is printed in advance on the rear surface of the downstream band base material 2C in the second winding region 7 as a region corresponding to the second adhesion position mark 19 in the second winding region 7 (FIG. 2A).

Figure 13:
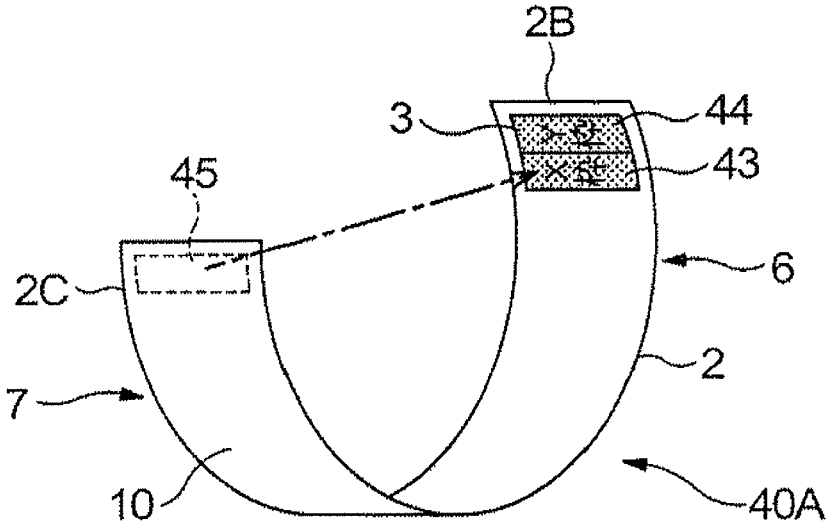
FIG. 13 is a perspective view of a first stage of winding a wristband 40A separated from a continuous body 40 of wristbands.
Figure 14:
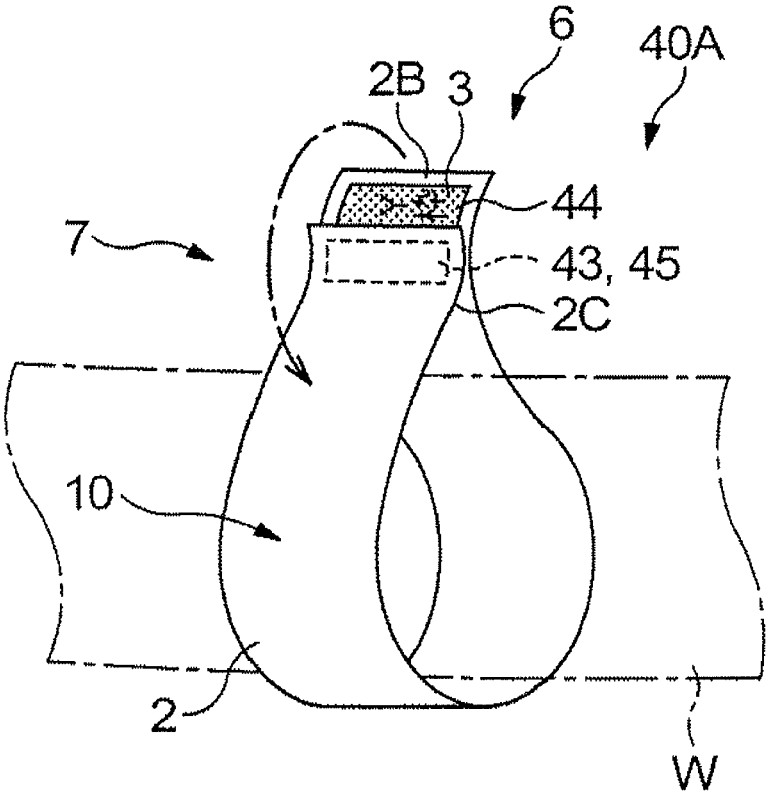
FIG. 14 is a perspective view of a first adhesion step of adhering a rear surface of the first winding region 6 to a rear surface of the second winding region 7.
Figure 15:
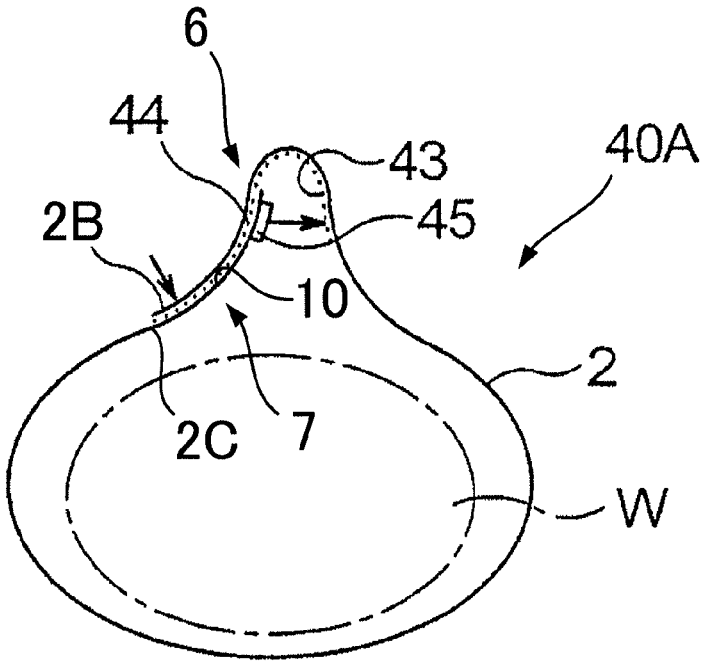
FIG. 15 is a cross-sectional view of a second adhesion step of adhering a rear surface of the first winding region 6 to a surface of the second winding region 7.

Now, FIGS. 13 to 15 show how to wind around the subject W the wristband 40A separated from the continuous body 40 in a configuration as above. FIG. 13 is a perspective view illustrating a first stage of winding the wristband 40A in one piece separated from the continuous body 40 of wristbands, and the mount 4 temporarily attached to the first adhesion region 43 and the second adhesion region 44 in the rear surface of the first winding region 6 is peeled off to expose the adhesive layer 3 (an exposure step). In the state shown in FIG. 13, the adhesion position mark 45 (a portion represented by "to frame X") in the second winding region 7 is adhered toward the direction (an arrow shown in FIG. 13) of the first adhesion region 43 (a portion represented by "frame X") in the first winding region 6.

FIG. 14 is a perspective view showing a first adhesion step of adhering the rear surface of the first winding region 6 to the rear surface of the second winding region 7. The adhesion position mark 45 in the second winding region 7 (the downstream band base material 2C) is adhered to the first adhesion region 43 in the first winding region 6 (the upstream band base material 2B) so as to match each other.

In short, the rear surface of the first winding region 6 having the adhesive layer 3 exposed and the rear surface of the second winding region 7 are possibly formed in a ring shape to wind it around the subject W by adhesively overlapping the first adhesion region 43 and the adhesion position mark 45 such that they are put together with each other while leaving a part (the second adhesion region 44 represented by "frame Y") of the adhesive layer 3 to be possibly exposed. In the first adhesion step, since the adhesion position mark 45 is merely represented by "to frame X", it is easy to put it on the first adhesion region 43.

Further, in the first adhesion step, the wristband 40A can be formed in a ring shape regardless if the subject W is at any place. The user may avoid doing a cumbersome operation of winding the wristband 1A by himself/herself alone and to make the wristband 40A in a ring shape to substantially a maximum diameter or a maximum size as designed.

FIG. 15 is a cross-sectional view illustrating a second adhesion step of adhering a rear surface of the first winding region 6 to a front surface of the second winding region 7. In this step, in a state where the subject W is inserted into the wristband 40A (FIG. 14) formed in a ring shape in the first adhesion step, the first winding region 6 (the upstream band base material 2B) having the adhesive layer 3 (the second adhesion region 44) remaining partially possibly exposed on the rear surface of the first winding region 6 is adhered to the front surface of the second winding region 7 (the downstream band base material 2C) so as to complete the winding to the subject W. In particular, as shown by each arrow in FIG. 15, the adhesion position mark 45 in the second winding region 7 is put on the first adhesion region 43 in the first winding region 6. Further, the upstream band base material 2B is adhered to the adhesion range printing column 10 of the second winding region 7 via the second adhesion region 44.

Therefore, in the first adhesion step as shown in FIG. 14, the wristband 40A can be adhered in a ring shape so as to obtain a maximum diameter with respect to the subject W, and then, in the second adhesion step as shown in FIG. 15, the wristband 30A can be adhesively secured in a ring shape while adjusting the diameter appropriate to the subject W varying in size to complete the winding.

Thus, the band base material 2 is possibly in direct contact with the subject W, and the continuous body 40 of wristbands can be manufactured at low cost due to a little consumption of the mount 4. Further, it is possible to wind the wristband 40A having a size appropriate to the size of the subject W. When, for example, the user winds by himself/herself alone, that can be carried out with both hands in the first adhesion step to ensure proper adhesion position or range, so that an adhesion state or an adhesion posture and an incorrect position significantly deviated from the proper position can be avoided.

Figure 16A:
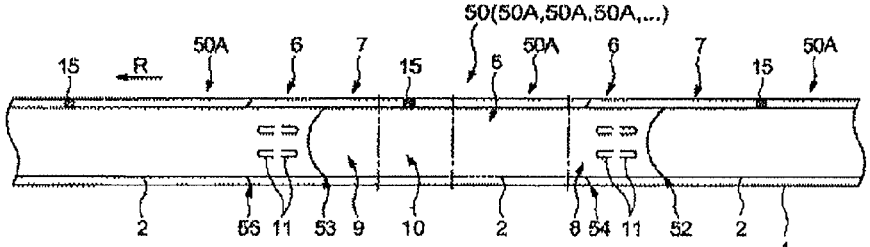
FIG. 16A is a plan view of a continuous body 50 of wristbands according to a fourth example of the present invention.
Figure 16B:
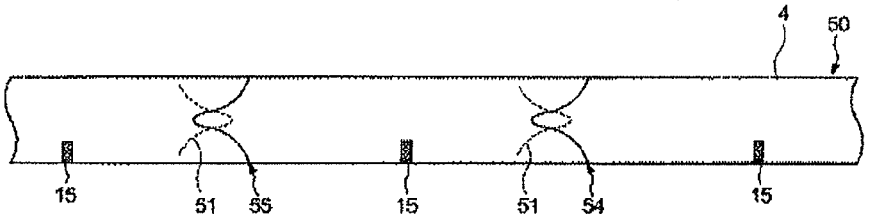
FIG. 16B is a rear view.
Figure 16C:
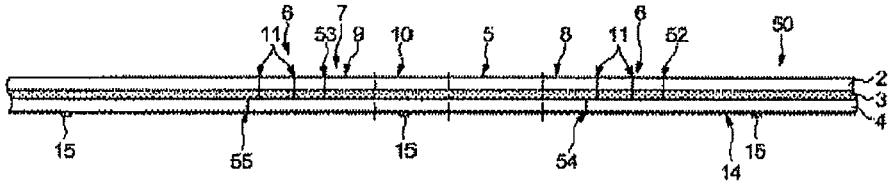
FIG. 16C is a cross sectional view thereof, respectively.
Figure 17A:
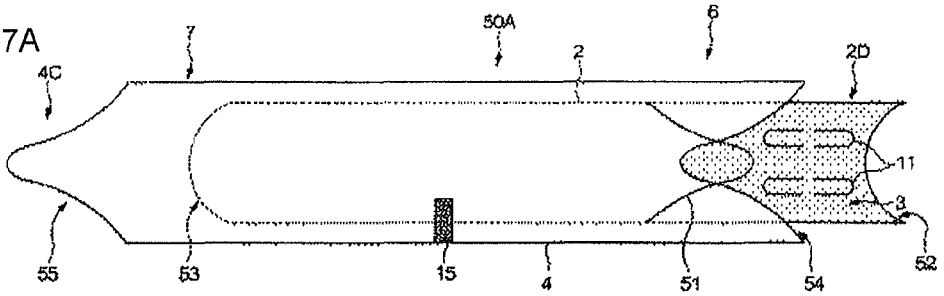
FIG. 17A is a rear view of a wristband 50A according to the fourth example of the present invention and FIG. 17B is a cross sectional view thereof, respectively.
Figure 17B:
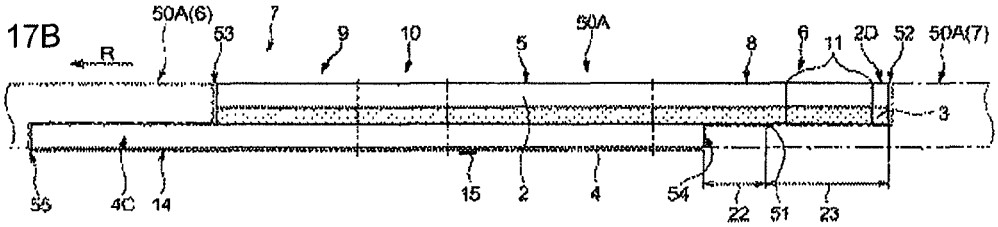

FIG. 16A to FIG. 20 describe a wristband, a continuous body of the wristbands and a method for winding the wristband according to a fourth example of the present invention. FIG. 16A is a plan view of a continuous body 50 of wristbands, FIG. 16B is a rear view, and FIG. 16C is a cross sectional view thereof, respectively. FIG. 17A is a rear view of a wristband 50A according to the fourth example of the present invention and FIG. 17B is a cross sectional view thereof, respectively. The continuous body 50 of wristbands and the wristband 50A, similar to the continuous body 30 of wristbands and the wristband 30A (the second example, FIGS. 6A, 6B, 6C, 7A, and 7B), differ from the continuous body 1 of wristbands and the wristband 1A (FIGS. 1A to 5) in a structure of both end portions of the mount 4, in which a first adhesion position guide (a flexion line mark 51 in a narrow mountain shape) and a second adhesion position guide (a mount 4C in a single layer having a tip end portion in a narrow mountain shape) are formed. In other words, the wristband 50A is obtained in a single piece by cutting a first band separation line 52 (a first cut for separating a band) at the upstream, which is in an arc shape convex in a direction R of transferring the continuous body 50 of wristbands, and a second band separation line 53 (a second cut for separating a band) at the downstream, which is similarly in an arc shape, with regard to the band base material 2, and also by cutting a first mount separation line 54 in a narrow mountain shape corresponding to a first mount separation line 31 of the continuous body 30 of wristbands and a second mount separation line 55 in a narrow mountain shape corresponding to the second mount separation line 32 of the continuous body 30 of wristbands.

Therefore, the mount 4 located on the opposite side (or downstream) of the band base material 2D in a single layer becomes the mount 4C, which has its tip end portion in a narrow mountain shape. The first adhesion position guide to meet with the mount 4C in a single layer is formed by printing in advance the flexion mark 51 on the adhesive layer 3 of the band base material 2D in a single layer. Conversely, the second adhesion position guide to meet with the first adhesion position guide (the flexion line mark 51) in the first winding region 6 is the mount 4C in a single layer having a tip end portion in a narrow mountain shape formed in advance.

Figure 18:
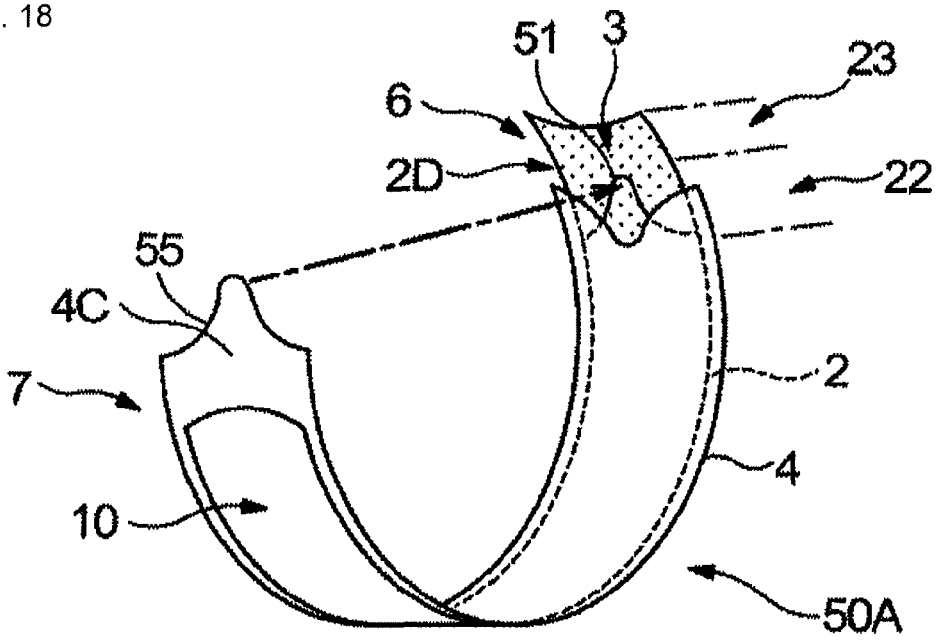
FIG. 18 is a perspective view of a first stage of winding a wristband 50A separated from a continuous body 50 of wristbands.
Figure 19:
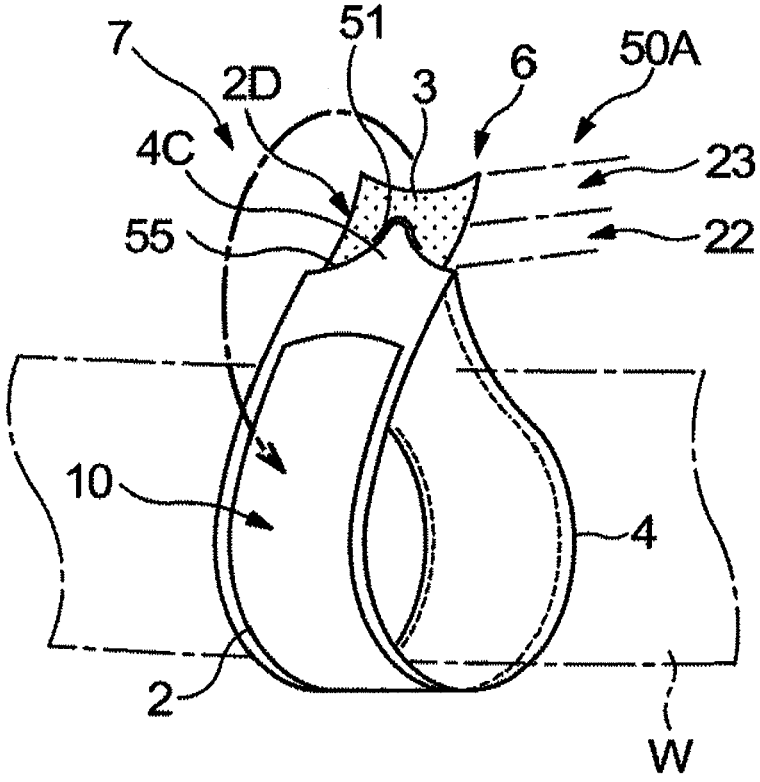
FIG. 19 is a perspective view of a first adhesion step of adhering a rear surface of the first winding region 6 to a rear surface of the second winding region 7.
Figure 20:
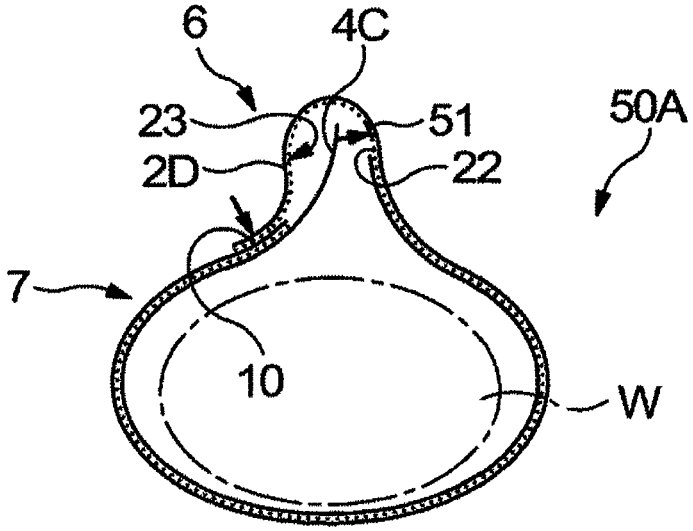
FIG. 20 is a cross-sectional view of a second adhesion step of adhering a rear surface of the first winding region 6 to a surface of the second winding region 7.

FIGS. 18 to 20 describe winding around the subject W the wristband 50A separated from the continuous body 50 in configuration as above. In the continuous body 50 of wristbands and the wristband 50A in one piece, similar to the continuous body 1 of wristbands and the wristband 1A (the first example, FIGS. 1A, 1B, 1C, 2A, and 2B) and the continuous body 30 of wristbands and the wristband 30A (the second example, FIGS. 6A, 6B, 6C, 7A, and 7B), the adhesive layer 3 is possibly exposed after the mount is peeled off from the rear surface of one end portion (the band base material 2D in a single layer) of the band base material 2. Also, the mount 4 (the mount 4C in a single layer) is exposed by peeling off the band base material 2 in the front surface of the other end portion of the band base material 2. So, the wristband 50A in one piece can be formed in a ring shape once the wristband 50A is separated from the most end portion of the continuous body 50 of wristbands. FIG. 18 is a perspective view illustrating a first stage of winding the wristband 50A in one piece separated from the continuous body 50 of wristbands, and the mount 4 on the rear surface of the first winding region 6 is peeled off to expose the adhesive layer 3 (an exposure step) in the same manner as the continuous body 30 of wristbands and the wristband 30A. Note that, since a band separation line 52 at the upstream is in an arc shape, it is easy to find a peeling position in separating the wristband 50A from the continuous body 50 of wristbands and workability is improved as result. In the state shown in FIG. 18, the mount 4C in a single layer in the second winding region 7 is adhered toward the direction (an arrow shown in FIG. 18) of the bend line 51 in a narrow mountain shape in the first winding region 6.

FIG. 19 is a perspective view illustrating a first adhesion step of adhering a rear surface of the first winding region 6 to a rear surface of the second winding region 7. The end portion in a narrow mountain shape of the mount 4C in a single layer in the second winding region 7 is adhered to the bend line 51 in a narrow mountain shape in the first winding region 6, and the end side of the mount 4C in a single layer is adhered to the adhesive layer 3 of the band base material 2D in a single layer. However, in the first adhesion step, since the mount 4C (the mount 4) in a single layer is transparent, it is possible to see through the end portion of the mount 4C in a single layer even when the end portion overlaps slightly the bend line 51 in the rear surface of the band base material 2D.

In short, the mount 4 (the mount 4C to be in a single layer on the upstream side when the next wristband 50A is in use) on the rear surface of the first winding region 6 is peeled off to possibly expose the adhesive layer 3. The rear surface of the first winding region 6 having the adhesive layer 3 exposed and the rear surface of the second winding region 7 are possibly formed in a ring shape to wind around the subject W by adhesively overlapping both rear surfaces such that the bend line mark 51 (the first adhesion position guide) and the end portion of the mount 4C (the second adhesion position guide) in a single layer are put together with each other while leaving a part (a second adhesion region 23) of the adhesive layer 3 to be possibly exposed. In the first adhesion step, since the mount 4C in a single layer has merely an edge portion in a predetermined shape, it is easy to put it on the bend line mark 51 in a narrow mountain shape.

Further, in the first adhesion step, the wristband 50A can be formed in a ring shape regardless of the subject W at a place away from the subject W in the same manner as the wristband 1A in the first example. So, it is possible for the user to avoid a cumbersome operation of winding the wristband 1A alone and making the wristband 50A in a ring shape to substantially a maximum diameter or a maximum size as designed.

FIG. 20 is a cross-sectional view illustrating a second adhesion step of adhering a rear surface of the first winding region 6 to a front surface of the second winding region 7. In this step, in a state where the subject W is inserted into the wristband 50A (FIG. 19) formed in a ring shape in the first adhesion step, the first winding region 6 having the adhesive layer 3 (the second adhesion region 23) remains partially possibly exposed on the rear surface of the first winding region 6 and is adhered to the front surface of the second winding region 7 so as to complete the winding to the subject W. In particular, as shown by each arrow in FIG. 20, the end portion of the mount 4C in a single layer in the second winding region 7 is put on the bend line mark 51 in a narrow mountain shape in the first winding region 6. The mount 4C in a single layer is adhered to the first adhesion region 22 in the first winding region 6 (the adhesive layer 3). Further, the band base material 2D in a single layer in the first winding region 6 is adhered to the adhesion range printing column 10 of the second winding region 7 via the second adhesion region 23.

Therefore, in the first adhesion step as shown in FIG. 19, the wristband 50A can be adhered in a ring shape so as to obtain a maximum diameter with respect to the subject W, and then, in the second adhesion step as shown in FIG. 20, the wristband 50A can be adhesively secured in a ring shape while adjusting the diameter appropriate to the subject W varying in size to complete the winding.

Thus, the mount 4 with embossment 14 is possibly in direct contact with the subject W during use, and can be used as it is without throwing it away. In addition, it is possible to wind the wristband 50A having a size appropriate to the size of the subject W. When, for example, the user himself/herself carries it out alone, the operation of winding can be carried out with both hands in the first adhesion step to ensure proper adhesion position or range, so that an adhesion state or an adhesion posture to an incorrect position significantly deviated from the proper position can be avoided.

Figure 21A:
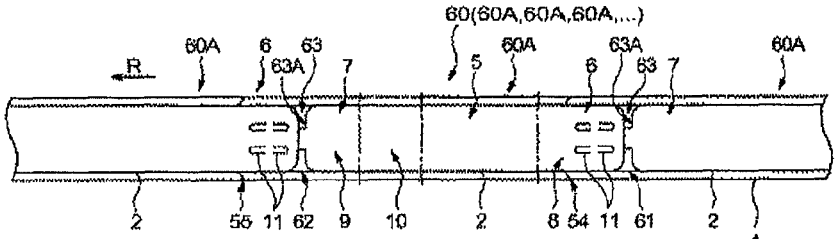
FIG. 21A is a plan view of a continuous body 60 of wristbands according to a fifth example of the present invention.
Figure 21B:
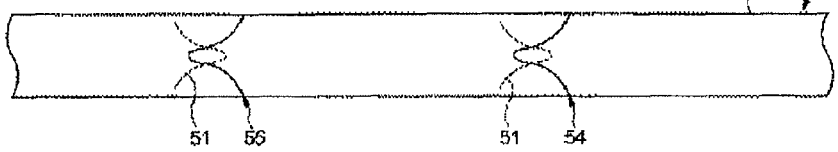
FIG. 21B is a rear view.
Figure 21C:
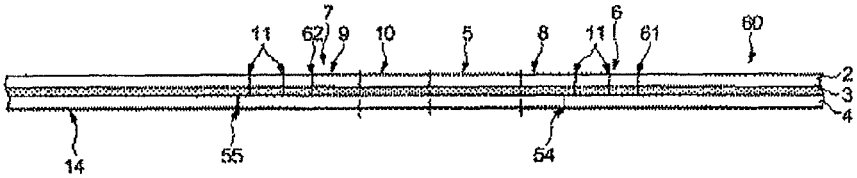
FIG. 21C is a cross sectional view thereof, respectively.

FIGS. 21A, 21B, and 21C describe a wristband, a continuous body of the wristbands and a method for winding the wristband according to a fifth example of the present invention. FIG. 21A is a plan view of a continuous body 60 of wristbands, FIG. 21B is a rear view, and FIG. 21C is a cross sectional view thereof, respectively. The continuous body 60 of wristbands and a wristband 60A, is similar to the continuous body 50 of wristbands and the wristband 50A (the fourth example, FIGS. 16A, 16B, 16C, 17A, and 17B), with the mount 4 formed with a first separation line 54 in a narrow mountain shape and a second separation line 55 in a narrow mountain shape. However, the band base material 2 is formed with a first band separation line 61 (a first cut for separating a band) at the upstream and a second band separation line 62 (a second cut for separating a band) at the downstream so as to obtain the wristband 60A in one piece.

Each of the first band separation line 61 and the second band separation line 62 is a cut for separating the wristbands 60A each in one piece and the same shape and a space 63 for detecting the position formed in the place of the cut for separating. Note that an edge surface portion 63A of the band base material 2 at either upstream or downstream of the space 63 for position detection is possibly detected with a position detection sensor (not shown) without printing a position detecting mark 15 in advance (see FIGS. 1A, 1B, and 1C, for example) on the rear surface of the mount 4. Therefore, it is possible to avoid difficulty in detecting the position if the position detection mark position 15 formed on the rear surface of the mount 4 should fall off due to wear.

Omitted is the detailed description of operations in winding the wristband 60A in one piece separated from the continuous body 60 of wristbands as configured above, since it is similar to steps as shown in FIGS. 18 to 20 with reference to the continuous body 50 and the wristband 50A according to the fourth example.

What is claimed is:

1. A method for winding a belt-shaped band around a subject, comprising:

putting together first and second adhesion position guides that are respectively provided at opposing first and second portions located in a longitudinal direction of the belt-shaped band such that the second portion of the belt-shaped band adheres to a region of an exposed part of an adhesive layer located on a rear surface of the first portion of the belt-shaped band, the region of the exposed part of the adhesive layer being defined by the first adhesion position guide; and affixing all of a remaining exposed part of the adhesive layer to a front surface of the belt-shaped band.

2. The method according to claim 1, wherein a diameter of the belt-shaped band is selectively adjusted by affixing the remaining exposed part of the adhesive layer to an arbitrary position of the front surface of the belt-shaped band.

3. The method according to claim 1, wherein a substantially maximum diameter of the belt-shaped band is obtained when putting together the first and second adhesion position guides such that the second portion of the belt-shaped band adheres to the region of the exposed part of the adhesive layer defined by the first adhesion position guide.

4. The method according to claim 1, wherein a surface area of the remaining exposed part of the adhesive layer is larger than a surface area of the region of the exposed part of the adhesive layer defined by the first adhesion position guide.

5. A belt-shaped band, comprising:

first and second adhesion position guides that are respectively provided at opposing first and second portions located in a longitudinal direction of the belt-shaped band; and an adhesion region located on a part of a rear surface of the first portion of the belt-shaped band, wherein the first and second adhesion position guides are configured and dimensioned such that a part of the adhesion region remains exposed when the first and second adhesion position guides are put together and all of a remaining exposed part of the adhesion region is affixed to a front surface of the belt-shaped band.

6. The belt-shaped band according to claim 5, further comprising:

a band base having an adhesive layer; and a mount adhesively attached to the adhesive layer.

7. The belt-shaped band according to claim 6, wherein the adhesion region is a region of the adhesive layer that is not covered by the mount.

8. The belt-shaped band according to claim 6, wherein the first adhesion position guide is provided on the band base.

9. The belt-shaped band according to claim 6, wherein the second adhesion position guide is provided on the mount.

10. The belt-shaped band according to claim 6, wherein the first adhesion position guide is provided on the band base, and the second adhesion position guide is provided on the mount.

11. The belt-shaped band according to claim 6, wherein the first and second adhesion position guides are configured and dimensioned such that a diameter of the belt-shaped band wound around a subject is selectively adjustable by affixing a remaining exposed part of the adhesive layer to an arbitrary position on the front surface of the belt-shaped band.

12. The belt-shaped band according to claim 5, wherein at least one of the first adhesion position guide and the second adhesion position guide is printed on the belt-shaped band.

13. The belt-shaped band according to claim 5, wherein at least one of the first adhesion position guide and the second adhesion position guide is a predetermined shape located on the belt-shaped band.

14. The belt-shaped band according to claim 5, further comprising a plurality of perforations in a width direction across the belt-shaped band.

15. The belt-shaped band according to claim 5, wherein the first and second adhesion position guides are configured and dimensioned such that a substantially maximum diameter of the belt-shaped band is obtained when the first and second adhesion position guides are put together.

16. The belt-shaped band according to claim 5, wherein the first and second adhesion position guides are configured and dimensioned such that a surface area of the remaining exposed part of the adhesion region is larger than a surface area of a part of the adhesion region to which the rear surface of the second portion is affixed when the first and second adhesion position guides are put together.

17. A method for winding a belt-shaped band around a subject, comprising:

defining a remaining exposed part of an exposed adhesive layer located on a rear surface of a first portion of a belt-shaped band by adhering a rear surface of a second portion of the belt-shaped band to the exposed adhesive layer; and adjusting a diameter of the belt-shaped band by selectively affixing the remaining exposed part of the exposed adhesive layer to an arbitrary position on a front surface of the belt-shaped band.

18. The method according to claim 17, further comprising:

using a second adhesion position guide provided at the second portion of the belt-shaped band to define the remaining exposed part of the exposed adhesive layer when the rear surfaces of the first and second portions of the belt-shaped band are adhered together.

19. The method according to claim 17, further comprising:

using first and second adhesion position guides located at the first and second portions of the belt-shaped band respectively to define the remaining exposed part of the exposed adhesive layer when the rear surfaces of the first and second portions of the belt-shaped band are adhered together.

20. The method according to claim 17, wherein a substantially maximum diameter is obtained when the rear surface of the second portion of the belt-shaped band is adhered to the exposed adhesive layer.

21. The method according to claim 17, wherein the rear surface of the second portion of the belt-shaped band is adhered to the exposed adhesive layer such that the remaining exposed part of the exposed adhesive layer has a relatively larger surface area than a region of the exposed adhesive layer to which the rear surface of the second portion of the belt-shaped band is adhered.

22. A band comprising:

a belt-shaped body having opposing first and second portions in a longitudinal direction; and an adhesive layer located on a rear surface of the first portion of the belt-shaped body, wherein a part of the adhesive layer is configured to remain exposed when a rear surface of the second portion of the belt-shaped body is adhered to the adhesive layer such that the remaining exposed part of the adhesive layer is selectively adherable to an arbitrary position on a front surface of the belt-shaped body so that a diameter of the band is adjustable.

23. The band according to claim 22, further comprising:

a first adhesion position guide provided at the first portion of the belt-shaped body, wherein the first adhesion position guide is configured to define the remaining exposed part of the adhesive layer when the rear surface of the second portion of the belt-shaped body is adhered to the adhesive layer.

24. The band according to claim 22, further comprising:

a second adhesion position guide provided at the second portion of the belt-shaped body, wherein the second adhesion position guide is configured to define the remaining exposed part of the adhesive layer when the rear surface of the second portion of the belt-shaped body is adhered to the adhesive layer.

25. The band according to claim 23, wherein the first adhesion position guide is printed on the belt-shaped body or is a predetermined shape located on the belt-shaped body.

26. The band according to claim 24, wherein the second adhesion position guide is printed on the belt-shaped body or is a predetermined shape located on the belt-shaped body.

27. The band according to claim 22, wherein the adhesive layer is configured such that a substantially maximum diameter of the band is obtained when the rear surface of the second portion of belt-shaped body is adhered to the adhesive layer.

28. The band according to claim 22, wherein a surface area of the remaining exposed part of the adhesive layer is larger than a surface area of a region of the adhesive layer to which the rear surface of the second portion of the belt-shaped body is adhered.

29. The belt-shaped band according to claim 5, wherein when the first and second adhesion position guides are put together to form a ring, an inner surface of the ring is non-adhesive.

30. The belt-shaped band according to claim 5, wherein the belt-shaped band has a constant width, and the first and second adhesion position guides are located in a middle of the belt-shaped band in a width direction.

* * * * *